US005256108A

United States Patent [19]

Whitmore et al.

[11] Patent Number: 5,256,108

[45] Date of Patent: Oct. 26, 1993

[54] PASSENGER POWERED AMUSEMENT RIDE

[76] Inventors: Stacy I. Whitmore, 140 W. 200 South; James A. Mayfield, 294 W. 2nd North, both of Richfield, Utah 84701

[21] Appl. No.: 918,076

[22] Filed: Jul. 24, 1992

[51] Int. Cl.[5] ..... A63G 1/12

[52] U.S. Cl. ..... 472/16; 472/44; 482/137

[58] Field of Search ..... 472/16, 17, 44, 95, 472/100; 482/133, 135, 136, 137, 140, 144, 145

[56] References Cited

U.S. PATENT DOCUMENTS

| | | | |
|---|---|---|---|
| 2,423,283 | 7/1947 | Austin | 427/16 |
| 3,127,169 | 3/1964 | Guihan | 472/16 |
| 3,152,802 | 10/1964 | Heisler et al. | 482/145 X |
| 3,197,203 | 7/1965 | Tieman | 472/16 |
| 3,207,508 | 9/1965 | Klemke | 472/16 X |
| 3,972,527 | 8/1976 | Bacon | 472/22 X |
| 4,147,343 | 4/1979 | Hyde et al. | 472/16 |
| 4,240,623 | 12/1980 | Edwards | 472/16 |
| 4,402,500 | 9/1983 | Coles | 472/30 X |

*Primary Examiner*—Carl D. Friedman
*Assistant Examiner*—Kien Nguyen
*Attorney, Agent, or Firm*—Terry M. Crellin

[57] ABSTRACT

A passenger powered, rotatable, amusement ride comprises a multisided, peripheral frame having the general shape of a convex polygon, with the frame having at least 5 sides and a number of apexes equal to the number of sides in the frame wherein the apexes alternate with the sides around the periphery of the frame. The frame has an open interior space bounded by internal surfaces of the sides of the frame. The frame is mounted to rotate like a wheel about a substantially horizontal axis through the central portion of the frame. A passenger is seated within the open interior space of the frame at an inside corner forming one of the apexes of the frame. A second passenger can be seated within the open interior space of the frame at an adjacent inside corner of the frame such that the second passenger faces the first passenger.

10 Claims, 2 Drawing Sheets

PASSENGER POWERED AMUSEMENT RIDE

BACKGROUND OF THE INVENTION

1. Field of the Invention

The present invention relates to amusement rides of the type in which a passenger rotates within a rotating wheel-type frame about a fixed pivot axis. More particularly, the present invention relates to an amusement ride wherein the passenger provides the motive power for the rotational movement of the rotating wheel-type frame.

2. State of the Art

Various types of rotational amusement rides are known. These rides vary from large ferris wheels and merry-go-rounds which carry dozens of persons to smaller type amusement devices that carry one or two passengers. Examples of the latter type devices are shown in U.S. Pat. Nos. 4,824,009 and 4,402,500. These devices all require external power sources for movement of the rotating members of the rides. Passenger powered amusement rides are known, of course. For example the simplified merry-go-rounds used in school playgrounds utilizes the passengers of the ride to provide rotational movement to the device. In U.S. Pat. No. 3,972,527, there is shown a device that has a passenger carrying cage similar to those used on ferris wheels. The passenger activates a lever mechanism with his arms to provide a rocking motion. The lever mechanism is connected to a chain and gear drive that is rather complicated and certainly restricts the degree of rotational movement available. There is no disclosure in the prior art known to applicants of a wheel type rotating amusement ride in which the rotating wheel is mounted for rotation about a substantially horizontal axis, with the passenger being seated within the open interior space of the wheel to provide rotational movement of the wheel by shifting body weight back and forth. It is accordingly a principal objective of the present invention to provide such a wheel type rotating amusement ride.

BRIEF DESCRIPTION OF THE INVENTION

The present invention provides a novel, unique passenger powered, rotatable, amusement ride having a multisided, peripheral frame having the general shape of a convex polygon. The frame has at least 5 sides and a number of apexes equal to the number of sides, with the apexes alternating with the sides around the periphery of the frame. The frame has an open interior space bounded by the internal surfaces of the sides of the frame.

The frame is mounted to rotate like a wheel about a substantially horizontal axis through the central portion of the frame. A passenger is seated within the open interior space of the frame and adjacent to one of the apexes of the frame. This allows the legs of the passenger to lie along an internal surface of one of the sides of the frame that extends from the apex at which the passenger is seated, while the back of the passenger can lie along an internal surface of an adjacent side of the frame that also extends from the apex at which the passenger is seated.

One or two passengers can ride the device of the present invention to derive recreational pleasure as well as to achieve exercise. The passenger or passengers by various body movements provide means for moving the wheel like frame initially in a rocking motion. The body motions of the passenger or passengers shifts the center of gravity of the wheel like frame and causes it to initially rock back and forth. With proper timing and coordination, the wheel like frame can be made to rotate all the way around it pivot axis, with the passenger or passengers riding in a continuous loops as the wheel like frame rotates about its pivot axis.

Additional objects and features of the invention will become apparent from the following detailed description, taken together with the accompanying drawings.

THE DRAWINGS

A preferred embodiment of the present invention representing the best mode presently contemplated of carrying out the invention is illustrated in the accompanying drawings in which:

FIG. 1 is a pictorial representation of a passenger powered, rotatable amusement ride in accordance with the present invention; and FIG. 2 is an end elevation of the amusement ride of FIG. 1.

DETAILED DESCRIPTION OF THE ILLUSTRATED EMBODIMENT

Figure 1:
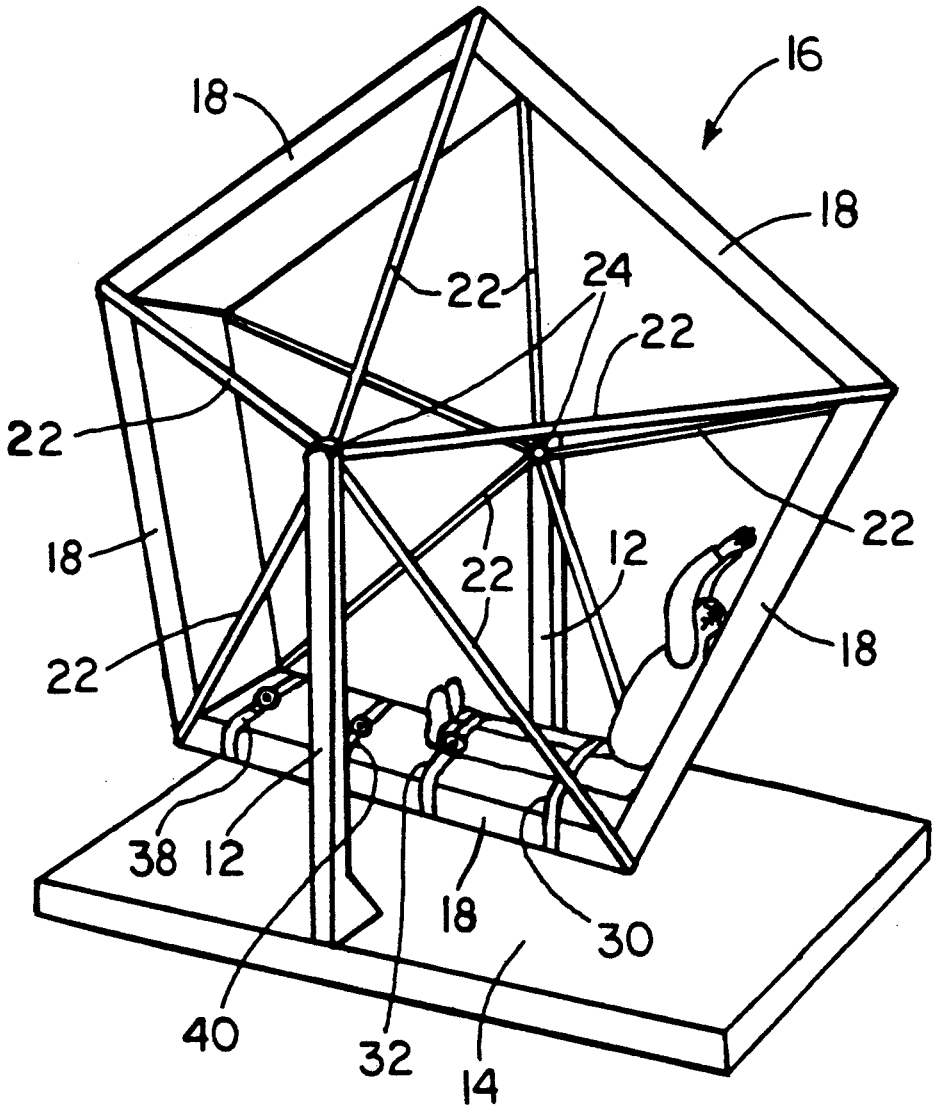
Figure 2:
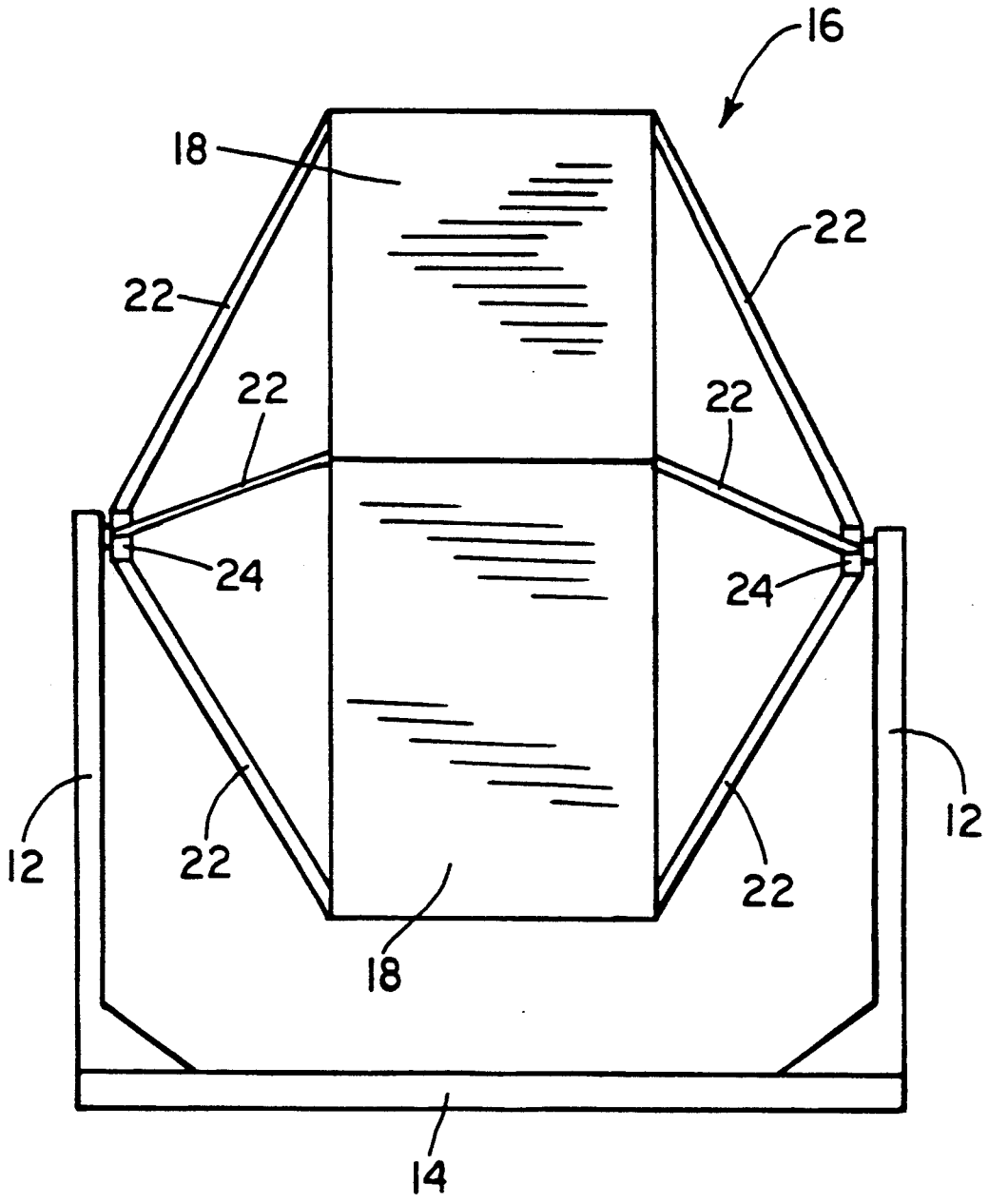

Referring to the drawings, two spaced apart, substantially vertical supports 12 extend upwardly from a support platform 14. A rotating, wheel like structure 16 is mounted between the vertical supports 12. The wheel like structure 16 comprises a multisided, peripheral frame 18 having the general shape of a convex polygon. The frame 18 has at least five sides, and in the preferred embodiment illustrated has five sides.

The wheel like frame 18 preferably consists of five members having the shape of elongate rectangles which are joined in end to end relationship to form a five sided polygon having five apexes equally spaced around its perimeter, with the apexes alternating with the rectangular shaped sides in forming the perimeter of the wheel like frame 18. The width of each of the rectangular members is not critical, but should be sufficient to allow at least one passenger to sit on the internal surface of the frame 18 at a corner formed at an apex between rectangular members. Generally, the frame 18 will have a width of at least about 2 feet to 3.5 feet or more. It should be recognized however that the width of the rectangular members could be doubled, tripled or even made larger is so desired to provide a rotating wheel apparatus that could accept two, three or more passengers sitting side-by-side of each other across the width of the rectangular members.

The frame 18 is supported for rotational motion by five spokes 22 at each of the open ends of the wheel like frame 18. The spokes 22 at each open end of the frame 18 extend to central, respective hubs 24 located at the upper ends of the vertical supports 12. The hubs 24 are adapted to rotate about a substantially horizontal axis extending through the two spaced apart hubs 24 such that the wheel like frame 18 can rotate in a substantially vertical plane about the axis through the hubs 24.

Means are provided for seating a passenger within the open interior space of the wheel like frame 18 at a V-shaped corner at one of the apexes of the frame 18. As illustrated, a lap belt 30 similar to such a belt used in an automobile or airplane is located closely adjacent to one of the apexes. A passenger can sit in the V-shaped internal corner formed by the juncture of the internal surfaces of two adjacent rectangular side members of the frame 18. The lap belt is used to hold the buttocks of the passenger firmly in the V-shaped corner.

A leg belt 32 is spaced along the internal surface of the rectangular side member of the frame such that the legs of the passenger can be retained firmly against the internal surface of that rectangular side member extending from the corner at which the passenger is seated. In this position, the passenger can rest his back along an internal surface of an adjacent rectangular side of the frame 18 that extends from the corner at which the passenger is seated. The passenger can do a conventional sit up type movement in which he pulls his arms and shoulders toward his feet thereby shifting his weight within the wheel like frame 18.

Means are preferably provided for seating a second passenger within the open interior space of the wheel like frame 18 and adjacent to a second apex, wherein the second apex is located next to the first apex at which the fist passenger is seated so that the second passenger can face the first passenger and the legs of the second passenger can lie along the same internal surface of the frame 18 as the legs of the first passenger. As illustrated, a second lap belt 38 similar to the first belt 30 is located closely adjacent to the corner formed at the second apex.

The first leg belt 32 can be used to retain the legs of the second passenger firmly against the internal surface of the rectangular side member adjacent to the legs of the first passenger. Preferably, a second leg belt 40 is provided similar to the leg belt 32, with the belts 32 and 40 being spaced from each other so that the first belt 32 will engage the lower portion of the legs of the second passenger and the knee portion of the legs of the first passenger. The second belt 40 will engage the lower portion of the legs of the first passenger and the knee portion of the legs of the second passenger.

The second passenger faces the first passenger and can do the same type sit up movement in which he pulls his arms and shoulders toward his feet. By coordinating the shifting of their weights by the sit up movements, the two passengers can readily make the wheel type frame 18 rotate in complete revolutions about the axis extending between the hubs 24.

As noted briefly before, the widths of the rectangular side members of the frame 18 can be increased to accommodate two or three passengers sitting side-by-side of each other and facing opposite passengers in the open are of the frame 18.

Additional exercises can be performed using the apparatus of the present invention. A push up type motion can be used by the passengers if the passengers strap their knees in the V-shaped corners rather than their hips. Then instead of doing a sit up type movement, the passengers do a push up type movement away from the internal surface of the wheel like frame 18.

For advanced users of the apparatus, their feet can be strapped to the corners of the internal surface of the wheel like frame 18 and they move their entire body back and forth in the plane of rotation of the wheel like frame 18. The passengers can extend their arms out to the internal surface of the frame 18 to do cartwheels as the wheel like frame 18 rotates. The advanced user can also use relatively light hand weights to provide a very complete work out of the upper body of the user. In addition, a strap (not shown in the drawings) can be extended between the hubs 24. Using the strap to stabilize himself, a passenger can use the wheel like frame 18 as a treadmill. The user simply steps from an internal surface of one rectangular member to the internal surface of the next rectangular member to cause the wheel like frame 18 to rotate.

Although preferred embodiments of the rotating amusement ride 24 of the present invention has been illustrated and described, it is to be understood that the present disclosure is made by way of example and that various other embodiments are possible without departing from the subject matter coming within the scope of the following claims, which subject matter is regarded as the invention.

We claim:

1. A passenger powered, rotatable, amusement ride comprising a multisided, peripheral frame having the general shape of a convex polygon, with said frame having at least 5 sides and a number of apexes equal to the number of sides in said frame, said apexes alternating with the sides around the periphery of said frame;

said frame having an open interior space bounded by internal surfaces of said sides of said frame;

means for mounting said frame to rotate like a wheel about a substantially horizontal axis through the central portion of said frame; and means for seating a passenger within the open interior space of said frame and adjacent to one of the apexes of said frame such that the legs of said passenger can lie along an internal surface of one of the sides of said frame that extends from said one apex while the back of said passenger lies along an internal surface of another of the sides of said frame that extends from said one apex.

2. A passenger powered amusement ride in accordance with claim 1 wherein means are further provided for seating a second passenger within the open interior space of said frame and adjacent to a second apex, wherein said second apex is adjacent to said one apex at which said first passenger is seated such that said second passenger can face said first passenger and the legs of said second passenger can lie along the same internal surface of said frame as the legs of said first passenger.

3. A passenger powered amusement ride in accordance with claim 2 wherein there are 5 sides, with each side having the shape of an elongate rectangle and the sides are joined in end to end relationship to form said apexes.

4. A passenger powered amusement ride in accordance with claim 3 wherein means are provided for restraining the legs of said passengers to lie along the internal surface of said one side of said frame.

5. A passenger powered amusement ride in accordance with claim 1 wherein there are 5 sides, with each side having the shape of an elongate rectangle and the sides are joined in end to end relationship to form said apexes.

6. A passenger powered amusement ride in accordance with claim 1 wherein the means for mounting said frame to rotate like a wheel comprises a base platform;

two upstanding support members, said support members being spaced apart by a distance at least as great as the width of the frame;

a rotatable hub mounted near the upper end of each of said upstanding support members;

a plurality of elongate support spokes extending from each hub member, each of said support spokes being connected at a distal end thereof to said frame such that said frame is rotatable about a substantially horizontal axis extending between said hubs.

7. A passenger powered amusement ride in accordance with claim 6 wherein means are further provided for seating a second passenger within the open interior space of said frame and adjacent to a second apex, wherein said second apex is adjacent to said one apex at which said first passenger is seated such that said second passenger can face said first passenger and the legs of said second passenger can lie along the same internal surface of said frame as the legs of said first passenger.

8. A passenger powered amusement ride in accordance with claim 7 wherein there are 5 sides, with each side having the shape of an elongate rectangle and the sides are joined in end to end relationship to form said apexes.

9. A passenger powered amusement ride in accordance with claim 8 wherein means are provided for restraining the legs of said passengers to lie along the internal surface of said one side of said frame.

10. A passenger powered amusement ride in accordance with claim 8 wherein each of said support members is connected at a distal end to the frame at respective apexes on said frame.

* * * * *